US008550854B2

(12) United States Patent
Okano et al.

(10) Patent No.: US 8,550,854 B2
(45) Date of Patent: Oct. 8, 2013

(54) EDGE CONNECTOR

(75) Inventors: Masato Okano, Machida (JP); Shin Sakiyama, Tokyo (JP)

(73) Assignee: Molex Incorporated, Lisle, IL (US)

( * ) Notice: Subject to any disclaimer, the term of this patent is extended or adjusted under 35 U.S.C. 154(b) by 5 days.

(21) Appl. No.: 13/378,003

(22) PCT Filed: Jun. 30, 2010

(86) PCT No.: PCT/US2010/040594

§ 371 (c)(1),
(2), (4) Date: Dec. 13, 2011

(87) PCT Pub. No.: WO2011/002880

PCT Pub. Date: Jan. 6, 2011

(65) Prior Publication Data

US 2012/0088388 A1 Apr. 12, 2012

(30) Foreign Application Priority Data

Jun. 30, 2009 (JP) ..... 2009-154787

(51) Int. Cl.
*H01R 24/00* (2011.01)

(52) U.S. Cl.
USPC ..... 439/631

(58) Field of Classification Search
USPC ..... 439/631, 260, 635, 325
See application file for complete search history.

(56) References Cited

U.S. PATENT DOCUMENTS

| | | | | |
|---|---|---|---|---|
| 3,923,364 | A * | 12/1975 | Shapiro et al. | 439/493 |
| 6,413,109 | B1 | 7/2002 | Kobayashi et al. | |
| 8,057,263 | B1 * | 11/2011 | Howard et al. | 439/631 |
| 2004/0016807 | A1 | 1/2004 | Huber | |

FOREIGN PATENT DOCUMENTS

| | | |
|---|---|---|
| JP | 05-074510 | 3/1993 |
| JP | 05-057788 | 7/1993 |
| JP | 10-321319 | 12/1998 |

OTHER PUBLICATIONS

International Search Report for PCT/US2010/040594.

* cited by examiner

*Primary Examiner* — Phuong Dinh
(74) *Attorney, Agent, or Firm* — Timothy M. Morella

(57) ABSTRACT

An edge connector is disclosed, having a configuration in which board contacting portions of terminals coming into contact with both ends of the board are displaced, an overall spring portion of each terminal applying an biasing force to the board contacting portions are displaced, and the surface of a cover member displacing the spring portion is configured as a sloped surface. Due to this configuration, it is possible to apply a stable biasing force to the board contacting portion without plastically deforming the terminals and to bring the board contacting portion of the terminal into secure contact with the board even when the thickness of the board varies greatly.

2 Claims, 4 Drawing Sheets

EDGE CONNECTOR

FIELD OF THE INVENTION

The present invention relates to an edge connector.

BACKGROUND OF THE INVENTION

Hitherto, an edge connector for connecting a counterpart connector to a side end of a board such as a printed circuit board has been proposed (reference should be made, for example, to Japanese Utility Model Application Laid-Open (Kokai) No. 05-057788).

FIG. 4 is a cross-sectional view of an edge connector according to the prior art.

In FIG. 4, an edge connector, which is connected to an edge of a board 891 such as a printed circuit board and generally designated by reference numeral 801, includes a housing 811 formed of an insulating material and terminals 861*a* and 861*b* formed of metal. The housing 811 has an opening portion 813 that is open to a side opposite to the board 891, and an insertion portion of a counterpart connector (not shown) is inserted into the opening portion 813. In the opening portion 813, first contacting portions 866*a* and 866*b* of the terminals 861*a* and 861*b* are arranged so as to come into contact with counterpart terminals (not shown) which are arranged in the insertion portion of the counterpart connector.

On a side of the housing 811 opposite to the opening portion 813, second contacting portions 864*a* and 864*b* of the terminals 861*a* and 861*b* are exposed so as to protrude outward. The board 891 is inserted into a space between the second contacting portions 864*a* and 864*b*, and then the second contacting portion 864*b* on the upper side is pressed towards the board 891 by a pressing member 812 formed of an insulating material. In this case, a bolt 843 and a nut 844 are screw-fastened with each other so as to bias the pressing member 812. In this way, the second contacting portions 864*a* and 864*b* are pressed against connection pads (not shown) being exposed to both surfaces of the board 891, whereby secure contact between the second contacting portions 864*a* and 864*b* and the connection pads is achieved.

However, in the conventional edge connector, since only the second contacting portion 864*b* on the upper side is displaced by the pressing member 812, it is difficult to ensure a sufficiently large adjustment range for the gap between the second lower contacting portion 864*a* and the second upper contacting portion 864*b*. Nevertheless, the adjustment range for the gap between the second lower contacting portion 864*a* and the second upper contacting portion 864*b* may be increased by increasing the amount of displacement of the second upper contacting portion 864*b*. However, when the amount of displacement of the second upper contacting portion 864*b* is increased, an excessive pressing force may be applied to the connection pads of the board 891 by the contacting portions 864, or the second upper contacting portion 864*b* may be plastically deformed. As a result, it is difficult to apply a stable pressing force to the connection pads of the board 891.

SUMMARY OF THE INVENTION

Therefore, it is an object of the present invention to obviate the above-described problems encountered by the conventional edge connector and to provide an edge connector having such a configuration that free ends of the board contacting portions of terminals coming into contact with both ends of the board are supported by a cover member so that the overall spring portion of the terminal applying an biasing force to the board contacting portion is displaced, and the surface of the cover member displacing the spring portion is configured as a sloped surface so that, even when the amount of displacement of the cover member is great, a sufficiently stable biasing force can be applied to the board contacting portion without plastically deforming the terminals. As a result, it is possible to bring the board contacting portion of the terminal into secure contact with the board even when the thickness of the board varies greatly. Accordingly, the edge connector can be produced to have a simple structure at a low cost with high durability and high reliability.

Therefore, an edge connector according to the present invention includes a housing having one end which is configured to be engaged, by fitting, with a counterpart connector body; terminals which are fitted in the housing, in which each of the terminals includes a connector contacting portion that is configured to come into contact with a counterpart connection portion of the counterpart connector body, and a board contacting portion that is configured to protrude from the other end of the housing in a direction opposite to the counterpart connector body and come into contact with a connection portion of a board; and a cover member which includes a first cover member and a second cover member arranged so as to oppose both surfaces of the board, and which is provided at the other end of the housing so as to accommodate the board contacting portions of the terminals. The first cover member is fixed to the housing, and the second cover member is coupled with the first cover member by a fastening means; and the fastening means fastens the first cover member and the second cover member with each other, whereby the edge connector is connected to the board.

Moreover, the cover member is provided with a terminal accommodation groove that accommodates the board contact portions of the terminals, and the board contact portion includes a cantilever-like contacting upper-arm portion which has one fixed end and is configured to extend obliquely towards the center in the thickness direction of the housing, a bent projection portion which is formed at the free end of the contacting upper-arm portion so as to come into contact with the connection portion, a spring portion which is configured to extend obliquely from the bent projection portion in a direction away from the center in the thickness direction of the housing, and an abutting portion which is formed at the free end of the spring portion so as to come into abutting contact with an inner wall of the terminal accommodation groove.

The edge connector according to another embodiment of the present invention has such a configuration that the inner wall of the terminal accommodation groove includes a sloped pressing surface that is approximately parallel to the spring portion, and the abutting portion comes into abutting contact with the sloped pressing surface.

In accordance with the present invention, the edge connector has a configuration in which the board contacting portions of the terminals coming into contact with both ends of the board are displaced, an overall spring portion of the terminal applying an biasing force to the board contacting portion is displaced, and the surface of the cover member displacing the spring portion is configured as the sloped surface. Due to this configuration, it is possible to apply a stable biasing force to the board contacting portion without plastically deforming the terminals and to bring the board contacting portion of the terminal into secure contact with the board even when the thickness of the board varies greatly. Accordingly, it is possible to provide an edge connector which can be produced to have a simple structure at a low cost with high durability and high reliability.

DESCRIPTION OF THE PREFERRED EMBODIMENTS

Description of preferred embodiments of the present invention will be provided below in detail with reference to the accompanying drawings.

Figure 1:
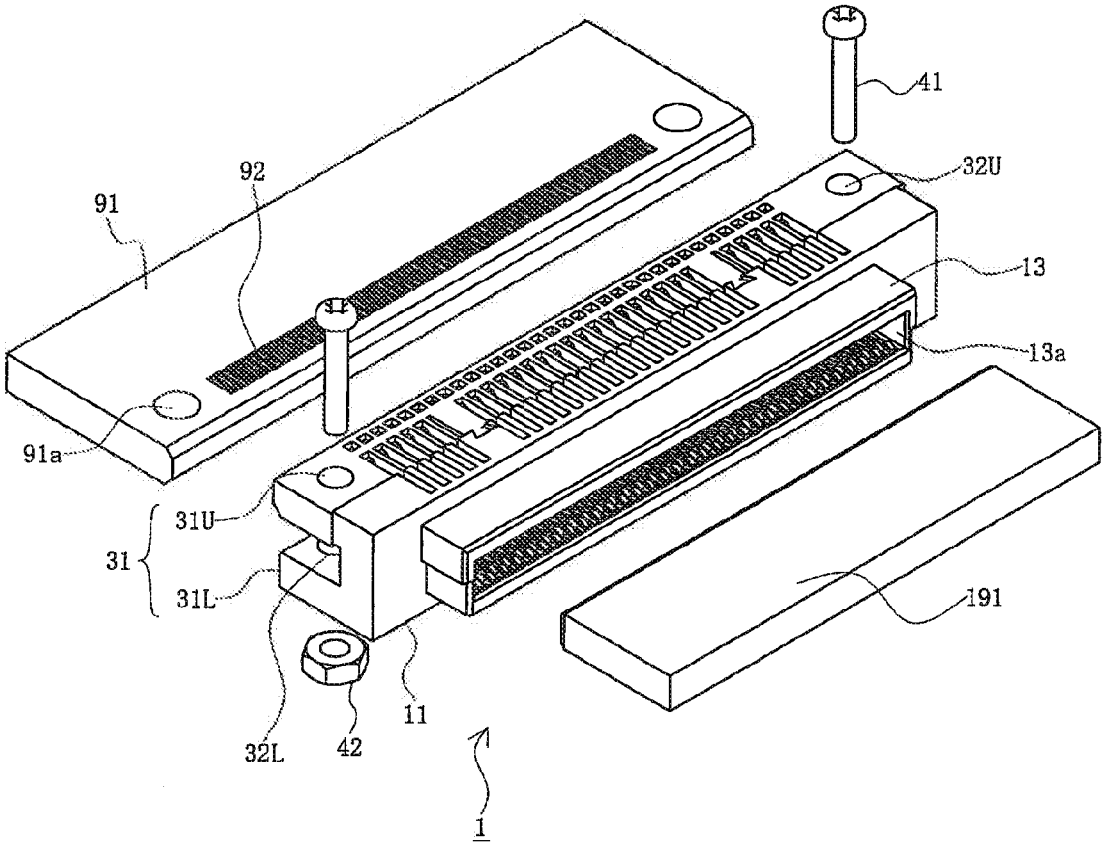
FIG. 1 is an exploded perspective view of an edge connector according to an embodiment of the present invention.
Figure 2:
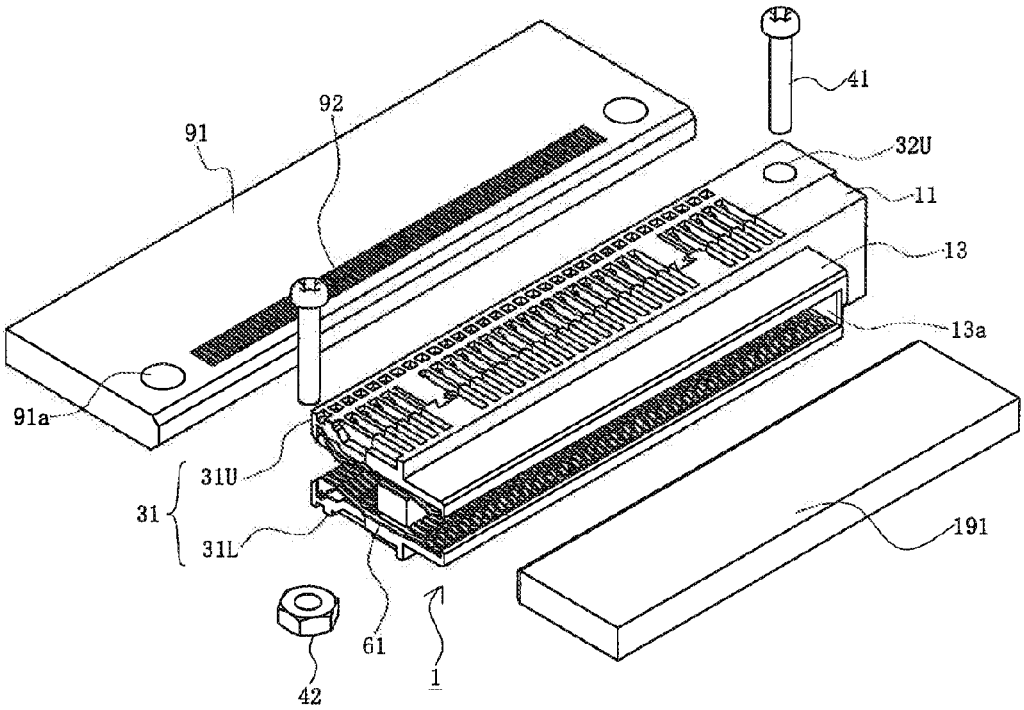
FIG. 2 is a partially cut-away, exploded perspective view of the edge connector according to the embodiment of the present invention.
Figure 3:
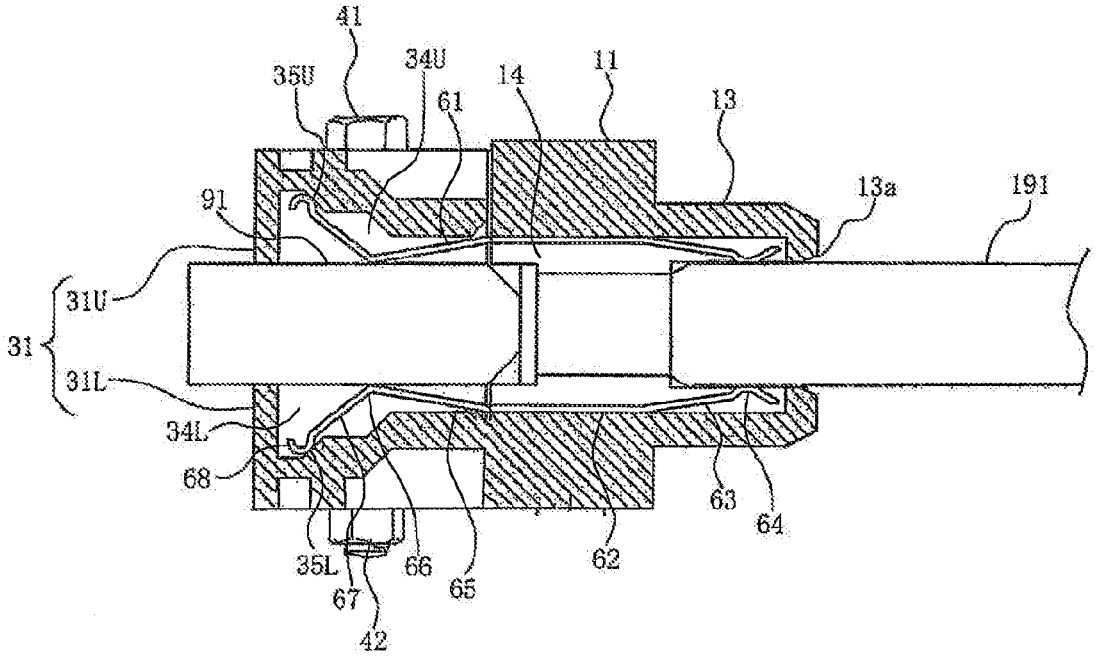
FIG. 3 is a cross-sectional view showing a state where the edge connector according to the embodiment of the present invention is engaged by fitting with a cable connector.
Figure 4:
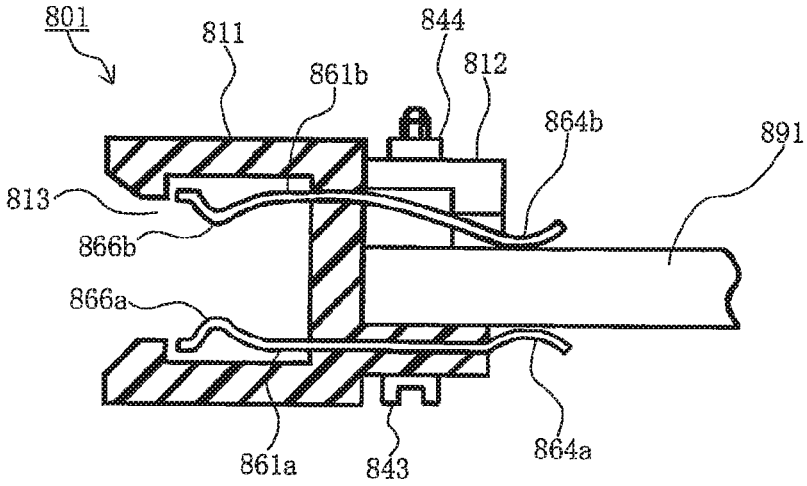
Prior Art FIG. 4
FIG. 4 is a cross-sectional view of an edge connector according to the prior art.

FIG. 1 is an exploded perspective view of an edge connector according to an embodiment of the present invention; FIG. 2 is a partially cut-away, exploded perspective view of the edge connector according to the embodiment of the present invention; and FIG. 3 is a cross-sectional view showing a state where the edge connector according to the embodiment of the present invention is engaged by fitting with a cable connector.

In these figures, an edge connector serving as a connector according to the present embodiment, generally designated by reference numeral 1, is connected to one end of a board 91 (specifically, an oblique lower right end in FIGS. 1 and 2, and a right end in FIG. 3), namely an edge portion. The edge connector 1 is configured to be engaged, by fitting, with a counterpart board 191 as a counterpart connector body. As the counterpart connector body, in addition to this, various connections such as a memory card, a connector, and the like may be used.

The board 91 and the counterpart board 191 are a flat plate-like cable which is called a printed circuit board, a flexible printed circuit (FPC), or a flexible flat cable (FFC), used in electronic devices or apparatuses such as computers, and electrical devices or apparatuses such as consumer electronic appliances, and may be any type of board as long as it is a flat plate-like cable. On both surfaces of the board 91 in the vicinity of the edge portion, connection electrodes 92 serving as a plurality of connection portions connected to conductive traces of the board 91 are exposed. The connection electrodes 92 are arranged along the edge portion as shown in FIG. 2. Similarly, on both surfaces of the counterpart board 191 in the vicinity of the edge portion, connection electrodes serving as a plurality of counterpart connection portions connected to conductive traces of the counterpart board 191 are exposed, but they are not shown in the figures.

In addition, in the present embodiment, representations of directions such as up, down, left, right, front, rear, and the like, used for explaining the structure and movement of the edge connector 1 and each part of other components is not absolute, but relative. These representations are appropriate when the edge connector 1 and each part of other components is in the position shown in the drawing figures. If the position of the edge connector 1 or each part of other components changes, however, it is assumed that these representations are to be changed according to a change in the position of the edge connector 1 or each part of other components.

The edge connector 1 includes a first housing 11 serving as a housing formed of an insulating material such as synthetic resin, a cover member 31 formed of an insulating material such as synthetic resin, and a plurality of terminals 61 which is formed of conductive metal and fitted in the first housing 11.

The first housing 11 has one end (the right end in FIG. 3) being engaged, by fitting, with the counterpart board 191 and the other end (the left end in FIG. 3) being connected to the edge portion of the board 91.

The cover member 31 includes an upper cover member 31U serving as a second cover member covering a portion of an upper surface of the board 91 in the vicinity of the edge portion and a lower cover member 31L serving as a first cover member covering a portion of a lower surface of the board 91 in the vicinity of the edge portion. The upper and lower cover members 31U and 31L are arranged on a side opposite to a fitting face (the right side face in FIG. 3) of the first housing 11. The lower cover member 31L is fixed to the first housing 11. The means for fixing the lower cover member 31L to the first housing 11 may be any kinds of means, and examples thereof include screw fastening, bonding, welding, and integral molding. The upper cover member 31U is coupled with the lower cover member 31L by bolts 41 and nuts 42 serving as a fastening means.

When the upper cover member 31U and the lower cover member 31L are collectively described, they will be referred to as the cover members 31. In addition, the upper cover member 31U and the lower cover member 31L have substantially the same structure. Therefore, when describing each part thereof, the same portions will be designated by the same numerals, to which symbols U and L will be attached if they belong to the upper cover member 31U and the lower cover member 31L, respectively.

Bolt holes 32U serving as coupling through-holes are formed on the upper cover member 31U, and bolt holes 32L serving as coupling through-holes are formed on the lower cover member 31L. The bolts 41 are inserted through the bolt holes 32U and 32L, whereby the upper cover member 31U is coupled with the lower cover member 31L.

Furthermore, bolt holes 91*a* serving as through-holes are formed on the board 91 at positions corresponding to the bolt holes 32U and 32L. The bolts 41 are inserted through these bolt holes 32U, 32L, and 91*a* and are screw-fastened with the nuts 42, whereby the portion of the board 91 in the vicinity of the edge portion can be vertically clamped by the upper cover member 31U and the lower cover member 31L. In this way, the board 91, the first housing 11, and the cover members 31 are coupled with each other, and the edge connector 1 is connected to the board 91.

The first housing 11 is provided with a convex engagement portion 13 with which the counterpart board 191 is engaged by fitting. The convex engagement portion 13 is provided with a counterpart-side accommodation-opening portion 13*a* which is open to the fitting face side, and a predetermined range of portions from the extreme end of the counterpart board 191 is permitted to come into the counterpart-side accommodation-opening portion 13*a*. The predetermined range of portions is a range of portions where at least a part of the connection electrodes is present.

The terminals 61 are fitted to a plurality of terminal accommodation grooves 14 which is formed on the upper and lower inner surfaces of the first housing 11. The terminal accommodation grooves 14 extend to the inside of the convex engagement portion 13.

The terminals 61 are an integral member formed by applying processing, e.g., punching and bending, to a metal plate.

As shown in FIG. 3, each of the terminals 61 includes a body portion 62 that is attached to the terminal accommodation grooves 14, a cantilever-like contacting fore-arm portion 63 that is configured to extend forward from the body portion 62, namely towards the fitting face, and a contacting bulging portion 64 that is configured to protrude from a portion of the contacting fore-arm portion 63 in the vicinity of the extreme end thereof towards the center in the thickness direction (the vertical direction in FIG. 3) of the first housing 11. In addition, each of the terminals 61 further includes a cantilever-like contacting upper-arm portion 65 that is configured to extend backward from the body portion 62, namely in a direction opposite to the fitting face and extend obliquely towards the center in the thickness direction of the first housing 11, a bent projection portion 66 that is formed by bending the free end of the contacting upper-arm portion 65 and configured to protrude towards the center in the thickness direction of the first housing 11, a supporting spring portion 67 serving as a spring portion that is configured to extend backward from the bent projection portion 66 and in a direction away from the center in the thickness direction of the first housing 11, and a supporting bulging portion 68 serving as an abutting portion that is configured to protrude from the free end, namely the rear end, of the supporting spring portion 67 in a direction away from the center in the thickness direction of the first housing 11.

The contacting fore-arm portion 63 and the contacting bulging portion 64 function as a counterpart contacting portion that comes into contact with the connection electrode of the counterpart board 191. Moreover, the contacting upper-arm portion 65, the bent projection portion 66, the supporting spring portion 67, and the supporting bulging portion 68 function as a board contacting portion that is configured to protrude from the other end of the first housing 11 so as to come into contact with the connection electrode 92 of the board 91.

At least a part of the contacting upper-arm portion 65, the bent projection portion 66, the supporting spring portion 67, and the supporting bulging portion 68 is received in the terminal accommodation groove 34U formed on the lower surface of the upper cover member 31U and the terminal accommodation groove 34L formed on the upper surface of the lower cover member 31L. The terminal accommodation grooves 34U and 34L are formed at positions corresponding to the terminal accommodation grooves 14 of the first housing 11 in the width direction of the edge connector 1.

In a state where the counterpart board 191 is engaged, by fitting, with the edge connector 1, the contacting bulging portion 64 comes into contact with each of the connection electrodes which are arranged on both surfaces of the counterpart board 191. In this case, since the contacting fore-arm portion 63 having elastic properties functions as a plate spring, the contacting bulging portion 64 is biased towards the surface of the connection electrode by an biasing force exerted by the contacting fore-arm portion 63, thus maintaining secure contact with the connection electrode.

Furthermore, in a state where the board 91, the edge connector 1, and the cover members 31 are coupled with each other, the bent projection portion 66 comes into contact with each of the connection electrodes 92 which are exposed to both surfaces of the board 91.

The supporting bulging portion 68 positioned at one end of the supporting spring portion 67 comes into abutting contact with the sloped pressing surface 35, which is formed in a part of the inner wall of the terminal accommodation groove 34, and is pressed towards the center in the thickness direction of the first housing 11 by the sloped pressing surface 35. Therefore, the bent projection portion 66 positioned at the other end of the supporting spring portion 67 is pressed against each of the connection electrodes 92 on the surface of the board 91. At this time, since the supporting spring portion 67 having elastic properties functions as a plate spring, the bent projection portion 66 is biased further towards the surface of each of the connection electrodes 92 by the biasing force exerted by the supporting spring portion 67, thus maintaining more secure contact with each of the connection electrodes 92.

As described above, when the edge connector 1 coupled with the board 91 is engaged, by fitting, with the counterpart board 191, the connection electrodes of the counterpart board 191 are electrically connected to the corresponding connection electrodes 92 of the board 91 via the terminals 61. Therefore, the conductive traces of the counterpart board 191 are electrically connected to the corresponding conductive traces of the board 91.

The pitch and the number of the terminals 61 may be appropriately configured to be suitable for the pitch and the number of the connection electrodes of the counterpart board 191 and the pitch and the number of the connection electrodes 92 of the board 91.

Meanwhile, in the present embodiment, the lower cover member 31L is fixed to the first housing 11 as described above. Therefore, the positional relationship between the lower cover member 31L and the first housing 11 is invariable. On the contrary, the positional relationship between the upper cover member 31U and the first housing 11 is variable, and the upper cover member 31U is configured to be displaced with respect to the first housing 11, specifically in the thickness direction of the first housing 11.

In general, in the case of printed circuit boards or flat plate-like cables used in electronic devices or apparatuses such as computers and electrical devices or apparatuses such as consumer electronic appliances, dimensional precision in the thickness direction thereof is relatively low and the thickness thereof varies greatly. For example, in the case of commercially available printed circuit boards, it is said that they have a variation of an approximately □10[%] of a specified thickness. In addition, both surfaces are not necessarily flat but have a local variation in the thickness thereof.

In the edge connector 1 according to the present embodiment, since the upper cover member 31U of the cover members 31 vertically clamping the board 91 is configured to be displaced in the thickness direction of the first housing 11, it is possible to absorb the thickness variation of the board 91. As described above, since the lower cover member 31L is unable to be displaced relative to the first housing 11, the upper surface of the lower cover member 31L making abutting contact with the lower surface of the board 91 functions as a reference surface for achieving positioning in the thickness direction of the board 91. Therefore, the upper cover member 31U is pressed from above against the upper surface of the board 91, whereby the positioning in the thickness direction of the board 91 is achieved based on the reference surface.

In this case, as described above, the bolts 41 are inserted through the bolt holes 32U, 32L, and 91*a* and are screw-fastened with the nuts 42, whereby the upper cover member 31U can be pressed against the upper surface of the board 91. In this way, it is possible to absorb the thickness variations of the board 91, achieve positioning in the thickness direction of the board 91 based on the reference surface, and vertically clamp and fix the board 91.

At that time, since the contacting upper-arm portion 65 and the supporting spring portion 67 having elastic properties function as a plate spring, the bent projection portion 66 positioned at the free end of the contacting upper-arm portion 65 of each of the terminals 61 is displaced so as to comply with the displacement in the thickness direction of each of the connection electrodes 92 on both surfaces of the board 91, thus maintaining stable contact with the connection electrode 92.

Moreover, the supporting bulging portion 68 positioned at one end of the supporting spring portion 67 comes into abutting contact with the sloped pressing surface 35, which is formed on a part of the inner wall of the terminal accommodation groove 34, and is pressed in towards the center in the thickness direction of the first housing 11 by the sloped pressing surface 35. The sloped pressing surface 35 is preferably sloped to be approximately parallel to the supporting spring portion 67 in the planar direction of the board 91. For this reason, when the upper cover member 31U is raised or lowered so as to displace the sloped pressing surface 35 in the thickness direction of the board 91, a component of the displacement vertical to the sloped pressing surface 35 will be smaller than the above-mentioned displacement. Therefore, the displacement of the supporting bulging portion 68 displaced by the sloped pressing surface 35 in the direction vertical to the sloped pressing surface 35 will be smaller than that when the supporting bulging portion 68 is displaced in the thickness direction of the board 91 by a plane extending in the planar direction of the board 91.

As described above, even when the upper cover member 31U is displaced greatly in the thickness direction of the board 91, the supporting bulging portion 68 positioned at one end of the supporting spring portion 67 which has the fixed end at the bent projection portion 66 being contacted with the connection electrode 92 is displaced by a relatively small distance. Therefore, the amount of overall displacement of the supporting spring portion 67 serving as a spring decreases, and the supporting spring portion 67 is prevented from being plastically deformed. Therefore, even when the bent projection portion 66 is displaced so as to comply with a local displacement in the thickness direction of each of the connection electrodes 92 on both surfaces of the board 91, the bent projection portion 66 is biased against the connection electrode 92 by a stable biasing force, thus maintaining more secure contact with the connection electrode 92.

As described above, the edge connector 1 according to the present embodiment includes the first housing 11 having one end which is configured to be engaged, by fitting, with the counterpart board 191; the terminals 61 which are fitted in the first housing 11, in which each of the terminals 61 includes a connector contacting portion that is configured to come into contact with the connection electrode of the counterpart board 191, and the board contacting portion that is configured to protrude from the other end of the first housing 11 in the direction opposite to the counterpart board 191 and come into contact with the connection electrode 92 of the board 91; and the cover member 31 which includes the lower cover member 31L and the upper cover member 31U arranged so as to oppose both surfaces of the board 91, and which is provided at the other end of the first housing 11 so as to accommodate the board contacting portions of the terminals 61. The lower cover member 31L is fixed to the other surface of the first housing 11, and the upper cover member 31U is coupled with the lower cover member 31L by the bolts 41 and the nuts 42. The bolts 41 and the nuts 42 fasten the lower cover member 31L and the upper cover member 31U with each other, whereby the edge connector 1 is connected to the board 91.

Moreover, the cover member 31 is provided with the terminal accommodation groove 34 that accommodates the board contacting portions of the terminals 61. The board contacting portion includes the cantilever-like contacting upper-arm portion 65 which has one end fixed to the first housing 11 and is configured to extend obliquely towards the center in the thickness direction of the first housing 11, the bent projection portion 66 which is formed at the free end of the contacting upper-arm portion 65 so as to come into contact with the connection portion 92, the supporting spring portion 67 which is configured to extend obliquely from the bent projection portion 66 in the direction away from the center in the thickness direction of the first housing 11, and the supporting bulging portion 68 which is formed at the free end of the supporting spring portion 67 so as to come into abutting contact with the inner wall of the terminal accommodation groove 34.

Due to this configuration, the contacting upper-arm portion 65 and the supporting spring portion 67 can be used as a plate spring for causing the bent projection portion 66 to come into contact with each of the connection electrodes 92. Thus, the bent projection portion 66 can be flexibly displaced so as to comply with a displacement in the thickness direction of each of the connection electrodes 92 on both surfaces of the board 91, thus maintaining stable contact with the connection electrode 92.

Furthermore, the inner wall of the terminal accommodation groove 34 includes the sloped pressing surface 35 that is approximately parallel to the supporting spring portion 67, and the supporting bulging portion 68 is configured to come into abutting contact with the sloped pressing surface 35. Due to this configuration, even when the amount of displacement of the cover member 31 is great, it is possible to decrease the amount of overall displacement of the supporting spring portion 67 that serves as a spring having a fixed end at the bent projection portion 66 and maintain more secure contact with the connection electrode 92.

The present invention is not limited to the above-described embodiments, and may be changed or modified in various ways based on the gist of the present invention, and these changes and modification are not eliminated from the scope of the present invention as claimed in the attached claims.

What is claimed is:

1. An edge connector comprising:

a housing having one end which is configured to be engaged, by fitting, with a counterpart connector body;

terminals which are fitted in the housing, in which each of the terminals includes a connector contacting portion that is configured to come into contact with a counterpart connection portion of the counterpart connector body, and a board contacting portion that is configured to protrude from the other end of the housing in a direction opposite to the counterpart connector body and come into contact with a connection portion of a board; and a cover member which includes a first cover member and a second cover member arranged so as to oppose both surfaces of the board, and which is provided at the other end of the housing so as to accommodate the board contacting portions of the terminals, wherein:

the first cover member is fixed to the housing, and the second cover member is coupled with the first cover member by a fastening means;

the fastening means fastens the first cover member and the second cover member with each other, whereby the edge connector is connected to the board;

the cover member is provided with a terminal accommodation groove that accommodates the board contacting portions of the terminals; and the board contacting portion includes a cantilever-like contacting upper-arm portion which has one fixed end and is configured to extend obliquely towards the center in the thickness direction of the housing, a bent projection portion which is formed at the free end of the contacting upper-arm portion so as to come into contact with the connection portion, a spring portion which is configured to extend obliquely from the bent projection portion in a direction away from the center in the thickness direction of the housing, and an abutting portion which is formed at the free end of the spring portion so as to come into abutting contact with an inner wall of the terminal accommodation groove.

2. The edge connector according to claim 1, wherein the inner wall of the terminal accommodation groove includes a sloped pressing surface that is approximately parallel to the spring portion, and the abutting portion comes into abutting contact with the sloped pressing surface.

* * * * *